US006446750B1

(12) United States Patent
Lewin

(10) Patent No.: US 6,446,750 B1
(45) Date of Patent: Sep. 10, 2002

(54) PROCESS FOR FILLING A MUFFLER SHELL WITH FIBROUS MATERIAL

(75) Inventor: David F. Lewin, Granger, IN (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/811,222

(22) Filed: Mar. 16, 2001

(51) Int. Cl.[7] ..... F01N 1/24

(52) U.S. Cl. ..... 181/256; 181/252; 181/257; 181/258

(58) Field of Search ..... 181/256, 252, 181/257, 258

(56) References Cited

U.S. PATENT DOCUMENTS

| | | | |
|---|---|---|---|
| 3,921,273 | A | 11/1975 | Kondo et al. |
| 4,569,471 | A | 2/1986 | Ingemansson et al. |
| RE32,258 | E | 10/1986 | Kondo et al. |
| 4,700,806 | A | 10/1987 | Harwood |
| 4,736,817 | A | 4/1988 | Harwood |
| 4,774,985 | A | 10/1988 | Broadbelt et al. |
| 5,036,585 | A | 8/1991 | Schweinfurth |
| 5,398,407 | A | 3/1995 | Stuer |
| 5,461,777 | A | 10/1995 | Ikeda et al. |
| 5,479,706 | A | 1/1996 | Tamano et al. |
| 5,701,737 | A | 12/1997 | Branik et al. |
| 5,766,541 | A | 6/1998 | Knutsson et al. |
| 5,783,782 | A | 7/1998 | Sterrett et al. |
| 5,859,394 | A | 1/1999 | Seehaus et al. |
| 5,907,904 | A | 6/1999 | Gerber et al. |
| 5,976,453 | A | 11/1999 | Nilsson et al. |
| 6,053,276 | A | 4/2000 | D'Amico, Jr. et al. |
| 6,068,082 | A | 5/2000 | D'Amico, Jr. et al. |
| 6,094,817 | A | 8/2000 | Shah et al. |
| 6,148,519 | A | 11/2000 | Stenersen et al. |
| 6,158,547 | A | 12/2000 | Ackermann et al. |
| 6,241,043 | B1 | 6/2001 | Goertz |
| 6,319,444 | B1 * | 11/2001 | Kirk ..... 264/136 |

FOREIGN PATENT DOCUMENTS

DE 3238638 * 4/1984

OTHER PUBLICATIONS

Brandt, US Pending 09/952,004, (Sep. 12, 2001).
Brandt, Pending Ser. No. 09/775,759, (Feb. 1, 2001).
Knutsson, Pending Ser. No. 98/802,492, (Feb. 1, 1997).

* cited by examiner

*Primary Examiner*—S Y Hsieh
(74) *Attorney, Agent, or Firm*—Inger H. Eckert; Stephen W. Barns

(57) ABSTRACT

A process is provided for filling a muffler shell with fibrous material. The process comprises the steps of: providing a muffler shell comprising first and second muffler shell outer parts which define an internal cavity when coupled together and an internal structure adapted to extend at least part way through the shell internal cavity for defining at least one channel having one or more openings communicating with the shell internal cavity; placing a form over at least one of the internal structure and the first muffler shell part; drawing a partial vacuum through a first end of the channel; feeding fibrous material into the form while drawing a partial vacuum through the channel; removing the form after the fibrous material feeding step; and positioning the second muffler shell part over at least one of the internal structure and the first muffler shell part.

19 Claims, 9 Drawing Sheets

PROCESS FOR FILLING A MUFFLER SHELL WITH FIBROUS MATERIAL

TECHNICAL FIELD AND INDUSTRIAL APPLICABILITY OF THE INVENTION

This invention relates to a process for filling a muffler shell with fibrous material.

BACKGROUND OF THE INVENTION

U.S. Pat. No. 4,569,471 to Ingemansson et al. describes a process and apparatus for feeding lengths of a continuous glass fiber strand into a muffler outer shell. The apparatus includes a nozzle for expanding the fiber strand into a wool-like material before the material enters the outer shell. In a first embodiment, filling of an outer cylinder 14 of the muffler shell occurs without an end-piece joined to the outer cylinder 14. After the filling operation is completed, the outer cylinder 14 is moved to a separate station where the end piece is welded onto the outer cylinder 14. In a second embodiment, illustrated in FIG. 3, a perforated pipe/outer end piece assembly is positioned only part way into the muffler outer cylinder 14 during the glass material filling operation. After the filling operation has been completed, the perforated pipe/end piece assembly is moved to its final position within the outer cylinder 14.

The '471 patent process is acceptable when filling a muffler shell of the type including a separate end piece or perforated pipe/outer end piece assembly. However, the process is typically not used with clam shell mufflers comprising first and second halves which, when coupled together and enclosing a perforated pipe, do not have an open end through which fibrous material may be fed. Some clam shell mufflers include internal plates which are positioned in face-to-face relationship and located between outer shell parts; see for example U.S. Pat. No. 5,859,394.

It is also known in the prior art to form preforms from glass material which are adapted to be inserted into a first muffler shell section prior to it being coupled to a corresponding second shell section; see U.S. Pat. No. 5,766,541, the disclosure of which is incorporated herein by reference. While such preforms are acceptable in performance, they add additional cost to the muffler due to the manufacturing steps necessary to form the preforms.

Hence, there is a need for an improved, low-cost muffler outer shell filling process which can be used to fill muffler shells such as clam-type muffler shells.

SUMMARY OF THE INVENTION

This need is met by the present invention, wherein a process is provided for filling a clam-type muffler shell using a form having open ends. The form is placed over one muffler shell part and/or an internal shell structure such as a pair of internal shell plates, which define at least one channel. The form is filled with a fibrous material. Thereafter, the form is removed and another muffler shell part is placed over the one part and/or the internal shell structure. The form defines a temporary container or mold for the fibrous material. A partial vacuum is preferably drawn through the channel during this process such that the fibrous material is pulled inside the form and later within a cavity defined by the muffler shell parts. It is noted that as the other muffler shell part is brought into contact with the one part and/or the internal shell structure, an increase in air velocity between those parts occurs due to the vacuum. The increased air velocity results in any glass fibers extending out beyond the edges of the shell parts and the internal shell structure being pulled inwardly inside an inner cavity of the muffler shell.

In accordance with a first aspect of the present invention, a process is provided for filling a muffler shell with fibrous material comprising the steps of: providing a muffler shell comprising first and second muffler shell outer parts which define an internal cavity when coupled together and an internal structure adapted to extend at least part way through the shell internal cavity for defining at least one channel having one or more openings communicating with the shell internal cavity; placing a form over at least one of the internal structure and the first muffler shell part; drawing a partial vacuum through a first end of the channel; feeding fibrous material into the form while drawing a partial vacuum through the channel; removing the form after the fibrous material feeding step; and positioning the second muffler shell part over at least one of the internal structure and the first muffler shell part.

The partial vacuum may also be drawn through the channel after the form is removed and during the positioning step.

The form may comprise a structure having upper and lower open sections and an outer perimeter shaped like that of one or both of the first and second shell parts.

The feeding step may comprise the steps of: providing a nozzle; feeding continuous strand material and pressurized air into the nozzle such that a wool-type product emerges from the nozzle; and positioning the nozzle adjacent to or in the form such that the wool-type product is fed into the form.

In a first embodiment, the internal structure comprises one or more perforated pipes which define one or more channels. In a second embodiment, the internal structure comprises a pair of stamped plates in face-to-face relationship which define the at least one channel. The stamped plates may be coupled together before or after the feeding step. The plates may be welded together, bolted together, or coupled together using any other conventional coupling arrangement.

The positioning step may comprise the step of positioning the second muffler shell part over the plates. The method may further comprise the steps of placing the plates over a deformable panel prior to the feeding step and removing the plates from the deformable panel after the second shell part has been positioned over the plates.

The placing step may comprise the step of placing the form over a first side of the pair of stamped plates. The method may further comprise the steps of: placing the form over a second side of the pair of stamped plates; drawing a partial vacuum through the first end of the channel; feeding fibrous material into the form while drawing a partial vacuum through the channel and with the form over the second side of the plates; removing the form after the fibrous material feeding step; and positioning the first muffler shell part over the plates and the second muffler shell part.

The process further comprises the step of coupling the first and second muffler shell parts together.

In accordance with a second aspect of the present invention, a muffler is provided which is filled with fibrous material in accordance with the process comprising the steps of: providing a muffler shell comprising first and second muffler shell outer parts which define an internal cavity when coupled together and an internal structure adapted to extend at least part way through the shell internal cavity for defining at least one channel having one or more openings communicating with the shell internal cavity; placing a form over at least one of the internal structure and the first muffler shell part; drawing a partial vacuum through a first end of the channel; feeding fibrous material into the form while drawing a partial vacuum through the channel; removing the form after the fibrous material feeding step; and positioning the second muffler shell part over at least one of the internal structure and the first muffler shell part.

In accordance with a third aspect of the present invention, a process is provided for filling a muffler shell with fibrous material comprising the steps of: providing a muffler shell comprising first and second muffler shell parts which define an internal cavity when coupled together and an internal structure adapted to extend at least part way through the shell internal cavity for defining at least one channel having one or more openings communicating with the shell internal cavity; placing a form over at least one of the internal structure and the first shell part; drawing a partial vacuum through a first end of the channel; feeding fibrous material into the form; removing the form after the fibrous material feeding step; and positioning the second muffler shell part over at least one of the internal structure and the first shell part.

The partial vacuum may be drawn through the channel during the fibrous material feeding step, after the form is removed and during the positioning step.

DETAILED DESCRIPTION AND PREFERRED EMBODIMENTS OF THE INVENTION

A process is provided for filling mufflers with fibrous material. Mufflers filled in accordance with the present invention are capable of being incorporated into vehicle exhaust systems and function as acoustic attenuators.

Figure 1:
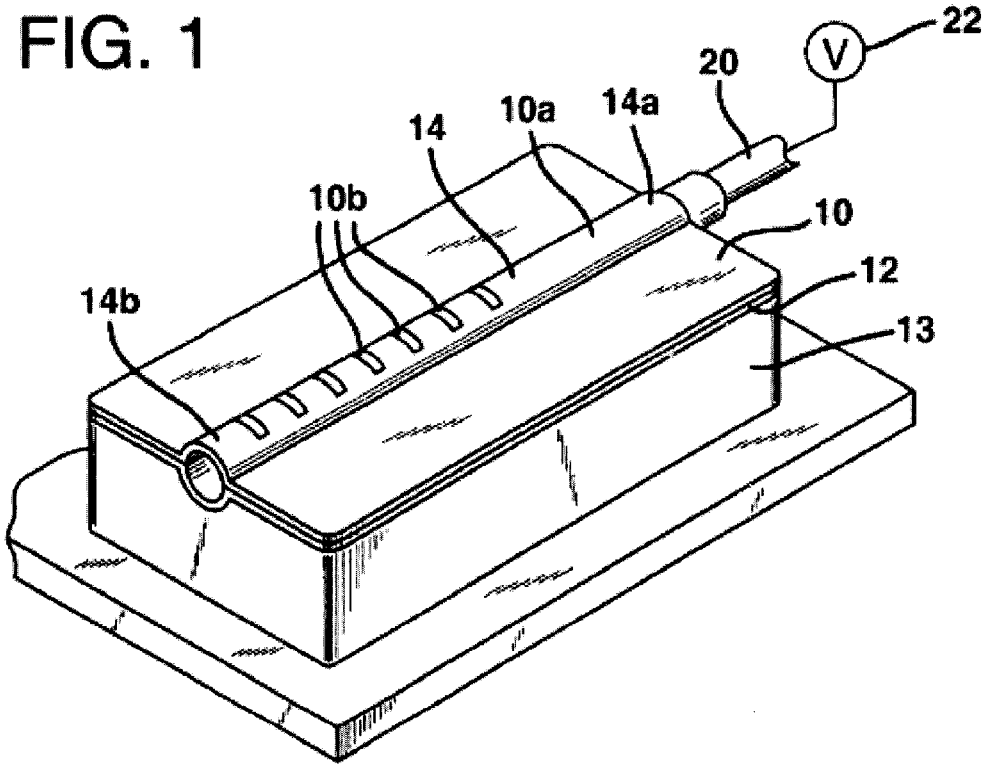
FIG. 1 illustrates a pair of stamped internal muffler plates positioned over a deformable panel.
Figure 9:
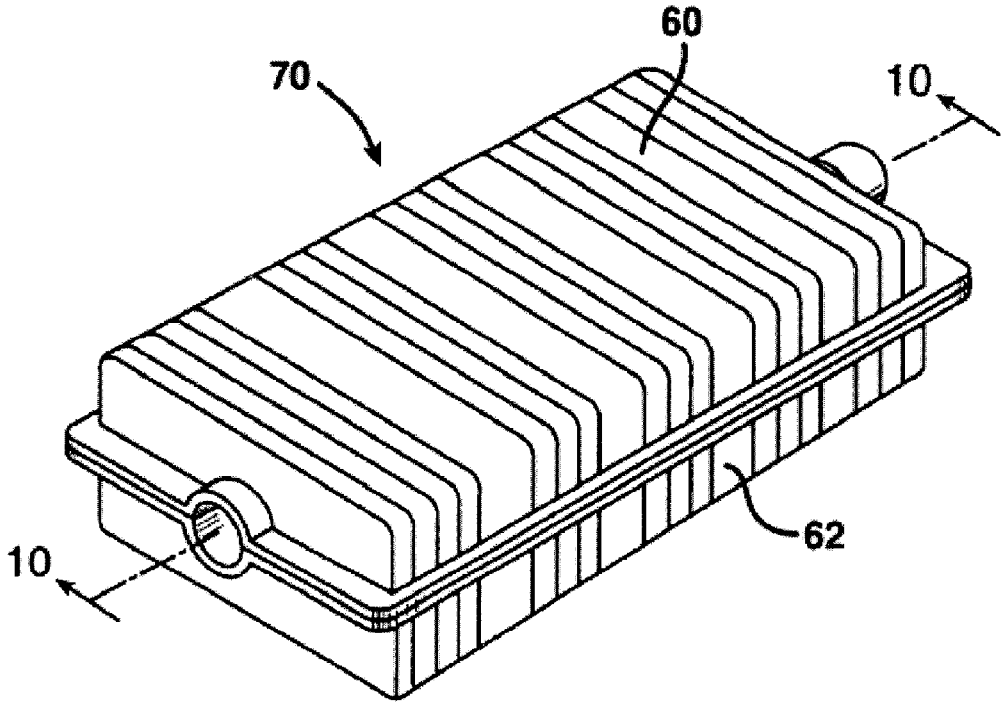
FIG. 9 illustrates the completed muffler filled in accordance with the process illustrated in FIGS. 1–8.

Referring now to FIG. 1, a pair of stamped internal muffler plates 10 and 12 are shown provided over a deformable panel 13 made, for example, from a polymeric material. Each plate 10 and 12 is provided with a raised section 10*a*, see FIG. 1, and 12*a*, see FIG. 5, which, when the plates 10 and 12 are placed in face-to-face relationship, define a channel 14. While only a single channel is shown in the illustrated embodiment, two or more channels may be defined by a plurality of raised sections in each plate 10 and 12. The channel 14 is provided with outer ends 14*a* and 14*b* adapted to receive or otherwise be coupled to vehicle exhaust pipes (not shown). The raised sections 10*a* and 12*a* are provided with a plurality of open louvers 10*b* and 12*b*. It is contemplated that openings or perforations may be provided in place of the louvers 10*b* and 12*b*. As will be discussed below, the internal plates 10 and 12 are positioned between first and second outer shells 60 and 62 (also referred to herein as shell outer parts) which, together with fibrous material 40, define a muffler 70, see FIG. 9.

Figure 2:
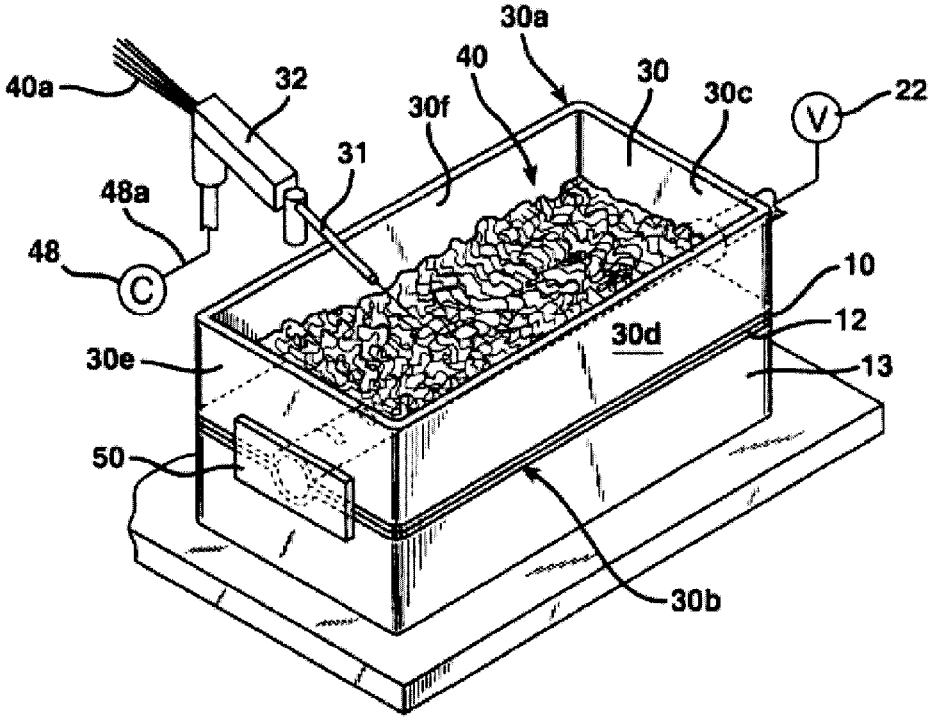
FIG. 2 illustrates the filling of a form placed over a first plate with fibrous material.

A form 30 having open upper and lower ends 30*a* and 30*b* is positioned over the plates 10 and 12, see FIG. 2. The form 30 may be formed from a substantially clear or opaque polymeric material, a metal, wood, or other rigid material. The form 30 preferably is shaped so as to extend about the outer periphery of the plates 10 and 12. The side walls 30*c*–30*f* of the form 30 are located in vertical planes in the embodiment illustrated in FIG. 2.

A nozzle 31 of a conventional texturizing device 32 is used to fill the form 30 with fibrous material 40. Such a device 32 is disclosed in U.S. Pat. Nos. 4,569,471 and 5,976,453, the disclosures of which are incorporated herein by reference.

Prior to the fibrous material 40 filling operation, a conduit 20, extending from a conventional vacuum source 22, is coupled to end 14*a* of the channel 14, see FIG. 1. While the vacuum source 22 is activated, a plate 50 is positioned over open end 14*b* of the channel 14 to prevent air from being drawn through that end. Hence, a partial vacuum is drawn through the louvers 10*b* and 12*b* such that air is removed or drawn out of the form 30 via the channel 14. The form 30 is then filled with fibrous material 40, preferably while the vacuum source 22 is activated. This occurs by placing the nozzle 31 just above or extending it into the open end 30*a* of the form 30, see FIG. 2. Continuous strand material 40*a* and pressurized air are then supplied to the texturizing device 32 until a desired amount of fibrous material 40 is provided in the form 40. The pressurized air is supplied from a conventional compressor 48, which communicates with the device 32 via a hose 48*a*. The continuous strand material 40*a* comprises one or more strands each of which may comprise a plurality of glass filaments selected from the group consisting of E-glass filaments and S-glass filaments. Preferably, the continuous strand material comprises a roving sold by Owens Corning under the trademark ADVANTEX® or the trademark Zen Tren™. The pressurized air separates and entangles the filaments of the strand material 40*a* so that the strand material emerges from the nozzle 31 as a continuous length of "fluffed-up" or fibrous material 40. The form 30 may be filled partially or completely depending upon the amount of fibrous material 40 required to achieve a desired muffler acoustic absorption rate. It is submitted that one skilled in the art will be able to determine the quantity or density of fibrous material 40 to be provided in the form 30 to achieve the absorption performance desired for a particular muffler filled using the process of this invention.

Figure 3:
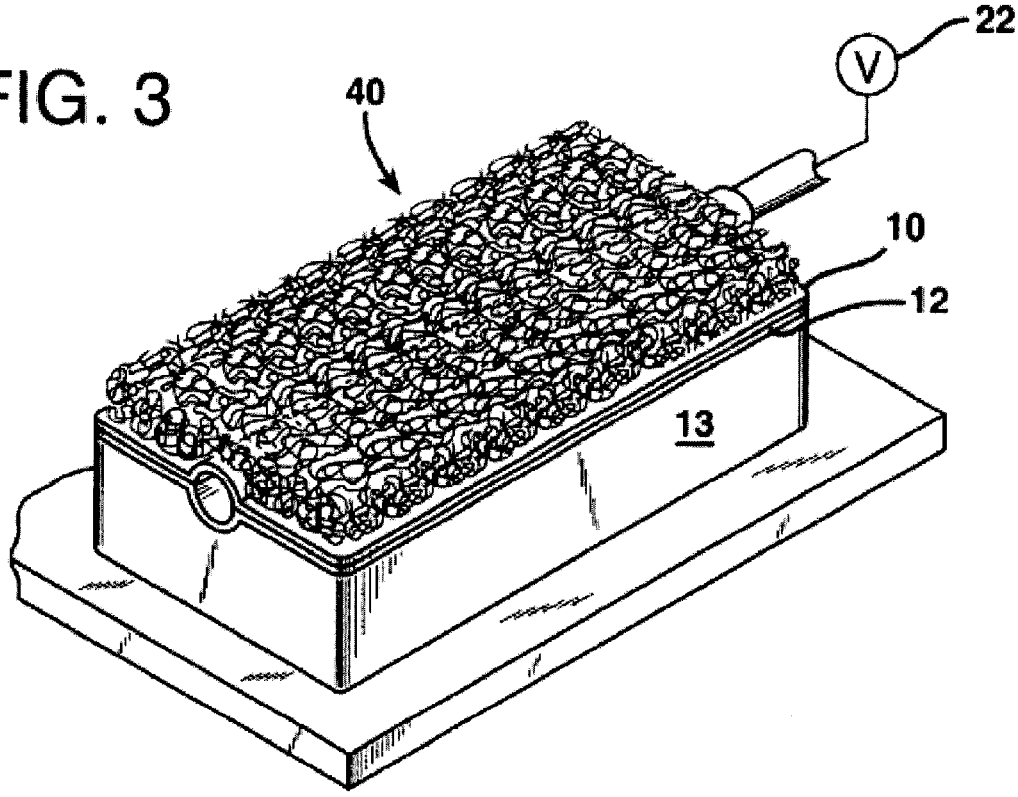
FIG. 3 illustrates the fibrous material and plates after the form has been removed.

After the form 30 is filled with a desired amount of fibrous material 40, it is removed, see FIG. 3. Preferably, the vacuum source 22 remains activated after the form 30 is removed. Once the form 30 is removed, the fibrous material 40 has sufficient structural integrity that it maintains generally the same shape it had while in the form 30.

Figure 4:
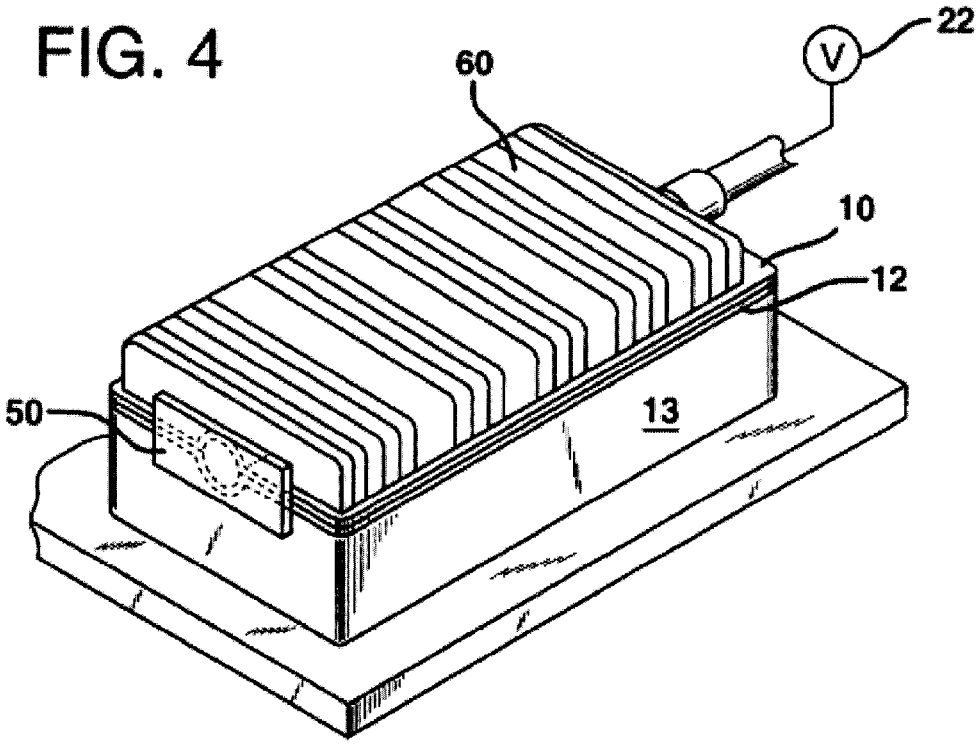
FIG. 4 illustrates a first shell placed over the fibrous material and plates illustrated in FIG. 3.

One of the shells 60 and 62, the first shell 60 in the illustrated embodiment, is then placed over the plates 10 and 12 such that it rests on top of plate 10, see FIG. 4. The shell 60 and the plates 10 and 12 may be temporarily or permanently coupled together at this juncture via welding, fasteners or clips.

Figure 5:
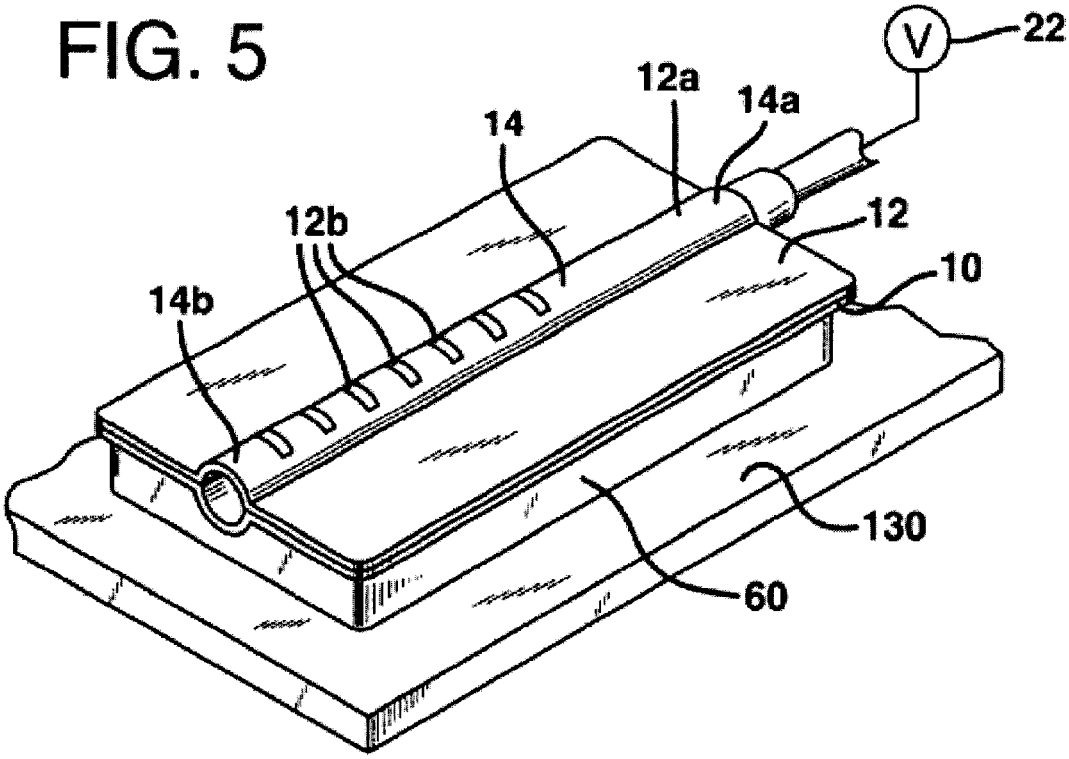
FIG. 5 illustrates the first shell and plates rotated and placed on a support.
Figure 6:
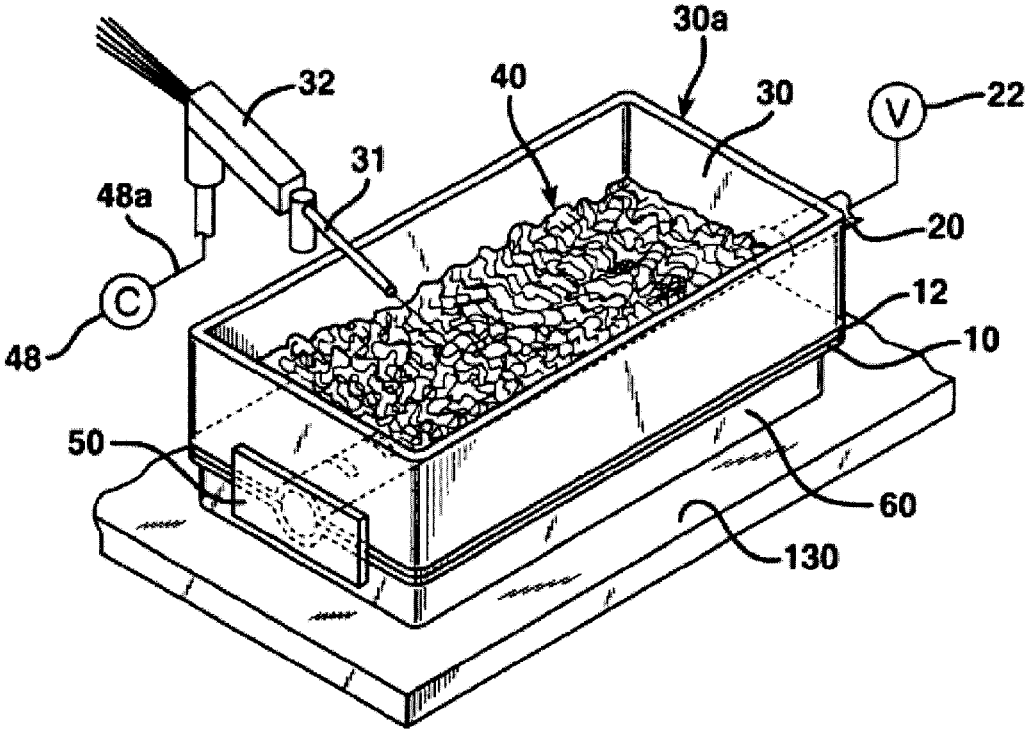
FIG. 6 illustrates the filling of the form placed over a second plate with fibrous material.

The plates 10 and 12 and the first shell 60 are then removed from the deformable panel 13, rotated and positioned on support 130, see FIG. 5. Next, the form 30 is positioned over plate 12. The form 30 is then filled with a desired amount of fibrous material 40 using texturizing device 32, preferably while the vacuum source 22 is activated, see FIG. 6.

Figure 7:
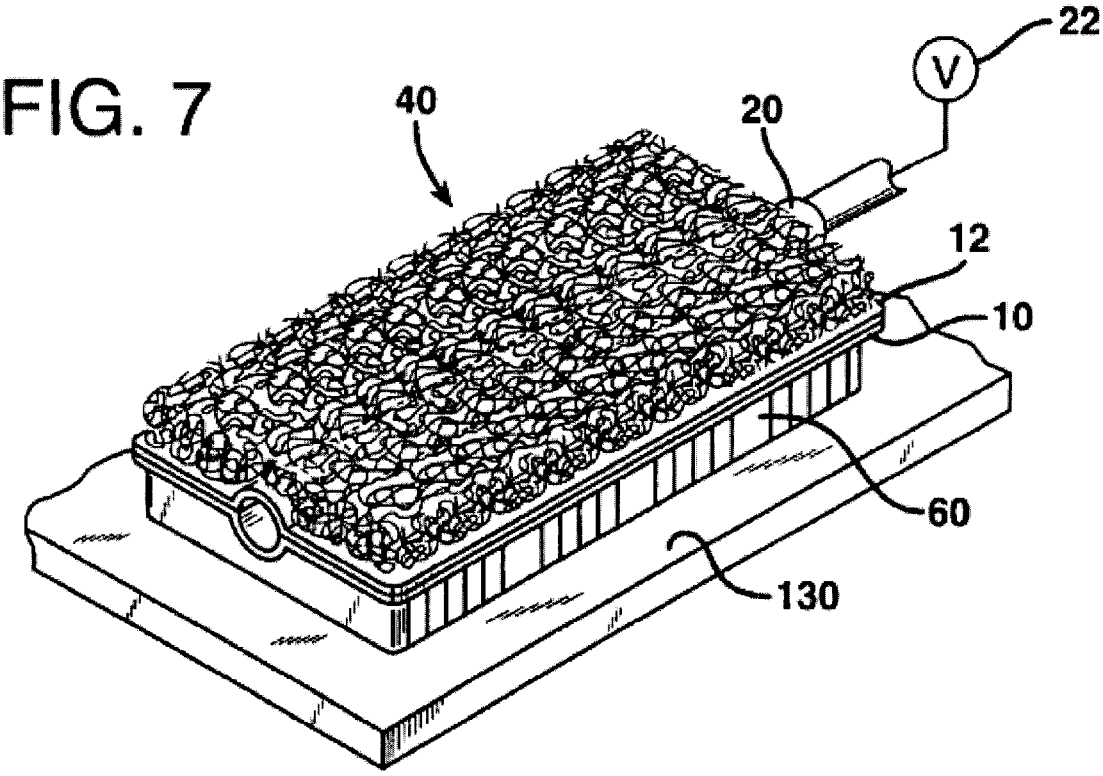
FIG. 7 illustrates the fibrous material, plates and first shell after the form is removed.

After the form 30 is filled with a desired amount of fibrous material 40, the form 30 is removed, see FIG. 7. With the vacuum source 22 continuing to draw air through the conduit 14, the second shell 62 is positioned over the plate 12. It is noted that as the muffler shell 62 is brought into contact with the plate 12, an increase in air velocity between those parts occurs due to the vacuum. The increased air velocity results in any glass fibers extending out beyond the edges of the shell 62 and plate 12 being pulled inwardly inside an inner cavity defined by the shell 62 and the plate 12.

Figure 8:
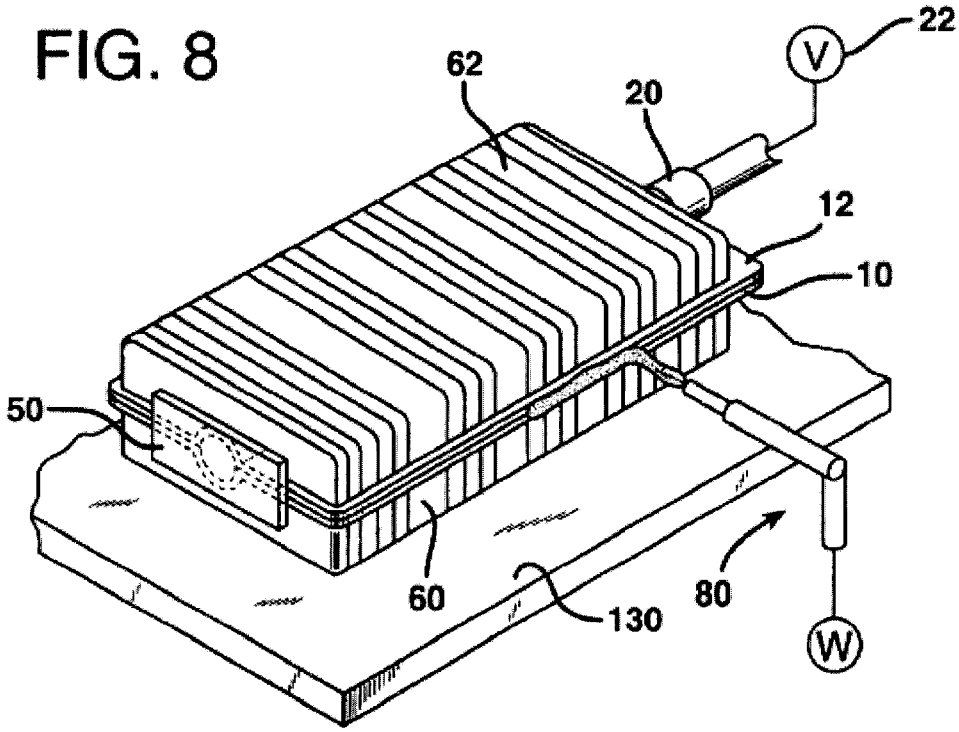
FIG. 8 illustrates a second shell placed over the fibrous material, the plates and the first shell as well as the welding of the plates and shells together.

Thereafter, the plates 10 and 12 and the shells 60 and 62 are coupled together via a welding operation using a welding apparatus 80, see FIG. 8. Alternatively, the plates 10 and 12 and the shells 60 and 62 may be coupled together using bolts, clips, bands or like fastening devices.

Figure 10:
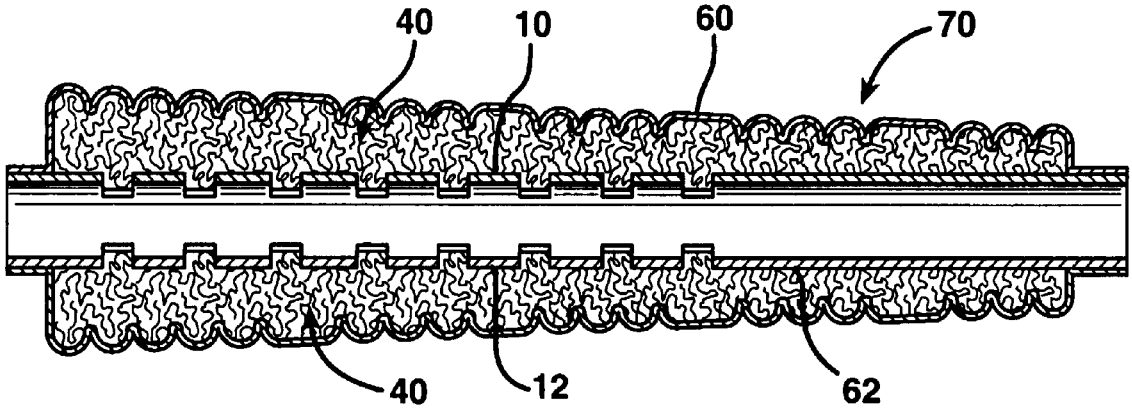
FIG. 10 is a view taken along section line 10—10 in FIG. 9.
Figure 10A:
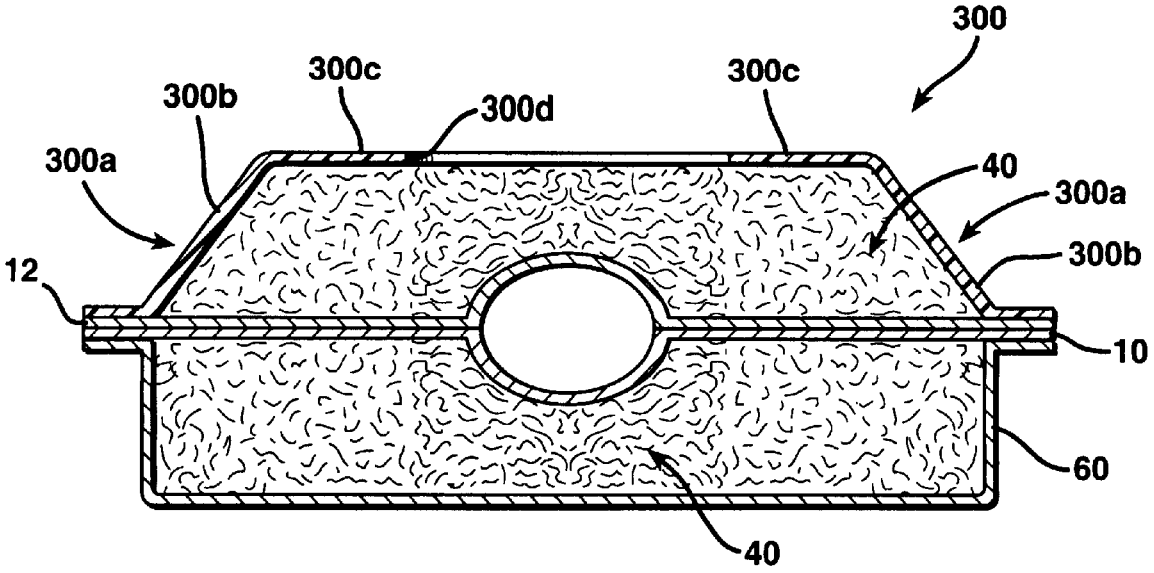
FIG. 10A illustrates a form constructed in accordance with an alternative embodiment.

In an alternative embodiment illustrated in FIG. 10A, where like elements are referenced by like numerals, a modified form 300 is shown. The form 300 comprises four side walls 300*a* (only two of which are illustrated in FIG. 10A). Each side wall 300*a* comprises an angled first portion 300*b* and a generally horizontal second portion 300*c*. The second portions 300*c* define a fill opening 300*d*. The form 300 is filled with fibrous material 40 by placing the nozzle 31 of the texturizing device 32 just above or extending it into the opening 300*d*. Continuous strand material 40*a* and pressurized air are then supplied to the texturizing device 32 until a desired amount of fibrous material 40 is provided in the form. The form 300 is then removed and the second shell 62 is positioned over the plate 12, see FIGS. 7 and 8. Thereafter, the plates 10 and 12 and the shells 60 and 62 are coupled together via a welding operation, bolts, clips, bands, etc.

Figure 15:
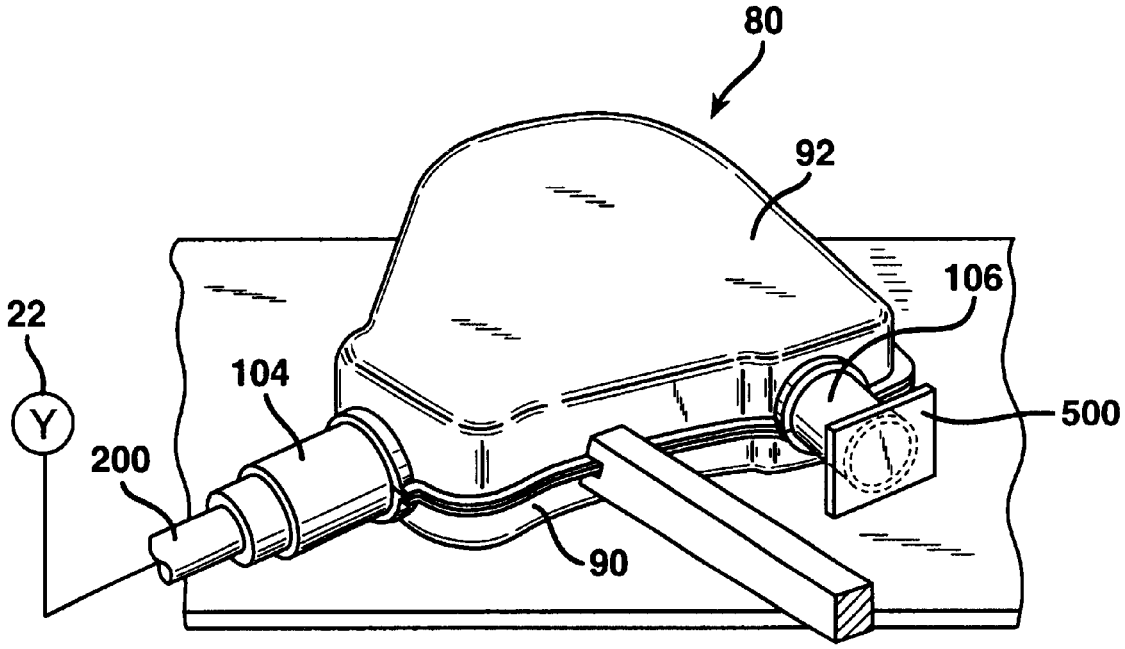
FIG. 15 illustrates the muffler after the second shell has been placed over the first shell, the fibrous material and the perforated pipe structure.
Figure 16:
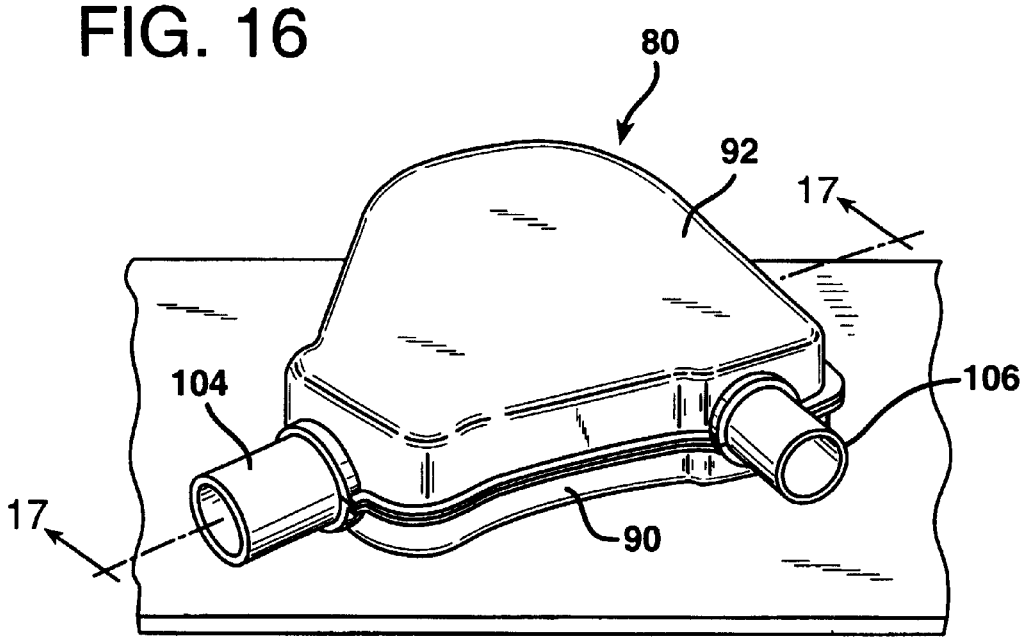
FIG. 16 is a perspective view of the completed muffler filled in accordance with the process illustrated in FIGS. 11–15.
Figure 17:
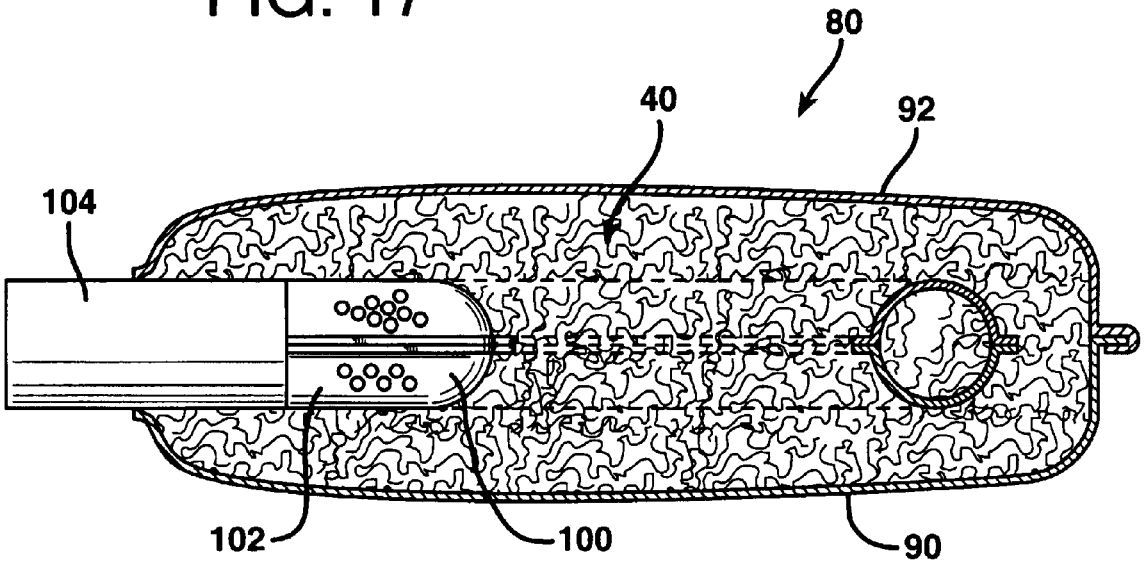
FIG. 17 is a view taken along section line 17—17 in FIG. 16.

The fibrous filling process of the present invention may also be used to fill a clam type muffler shell 80 devoid of first and second internal plates, see FIG. 16. Such a process will be discussed with reference to FIGS. 11–17, where like reference numerals indicate like elements.

Figure 11:
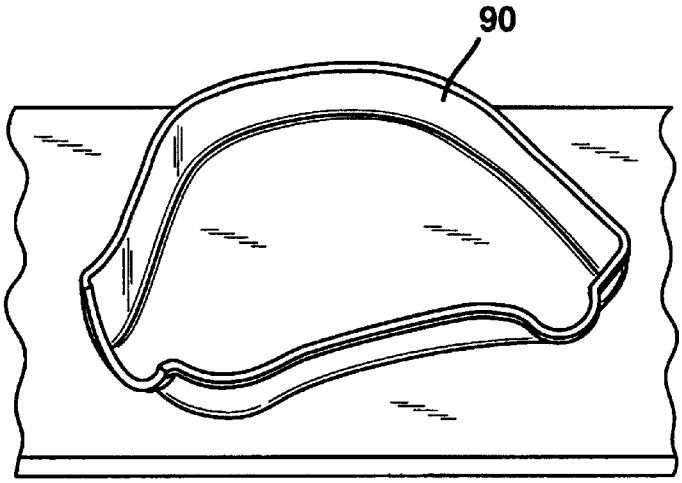
FIG. 11 is a perspective view a first muffler shell of a second muffler type filled in accordance with the present invention.
Figure 12:
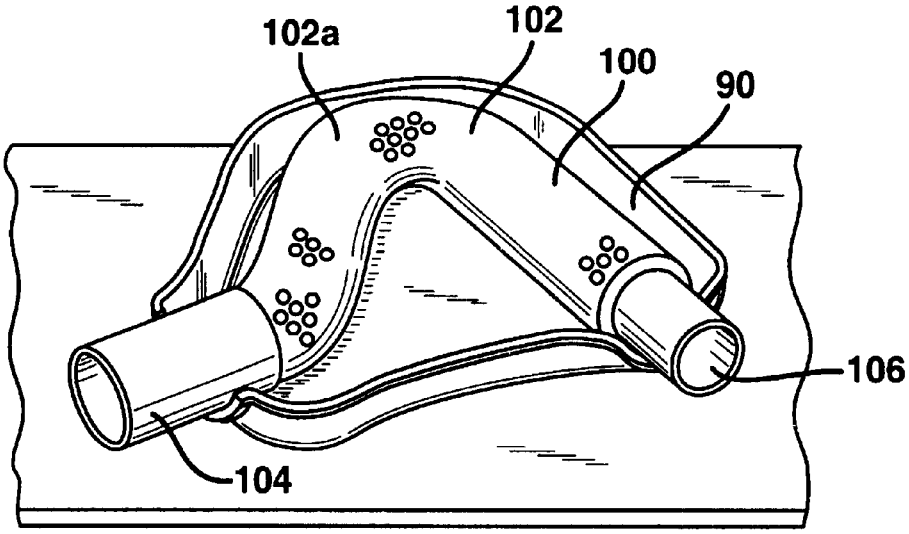
FIG. 12 is a perspective view of the shell illustrated in FIG. 11 along with a perforated pipe structure.

In FIG. 11, a first outer shell 90 of the muffler 80 is illustrated. In FIG. 12, an internal structure 100 comprising a perforated pipe structure 102 with first and second ends 104 and 106 is shown positioned in the shell 90. The pipe structure 102 defines a channel 102*a*.

Figure 13:
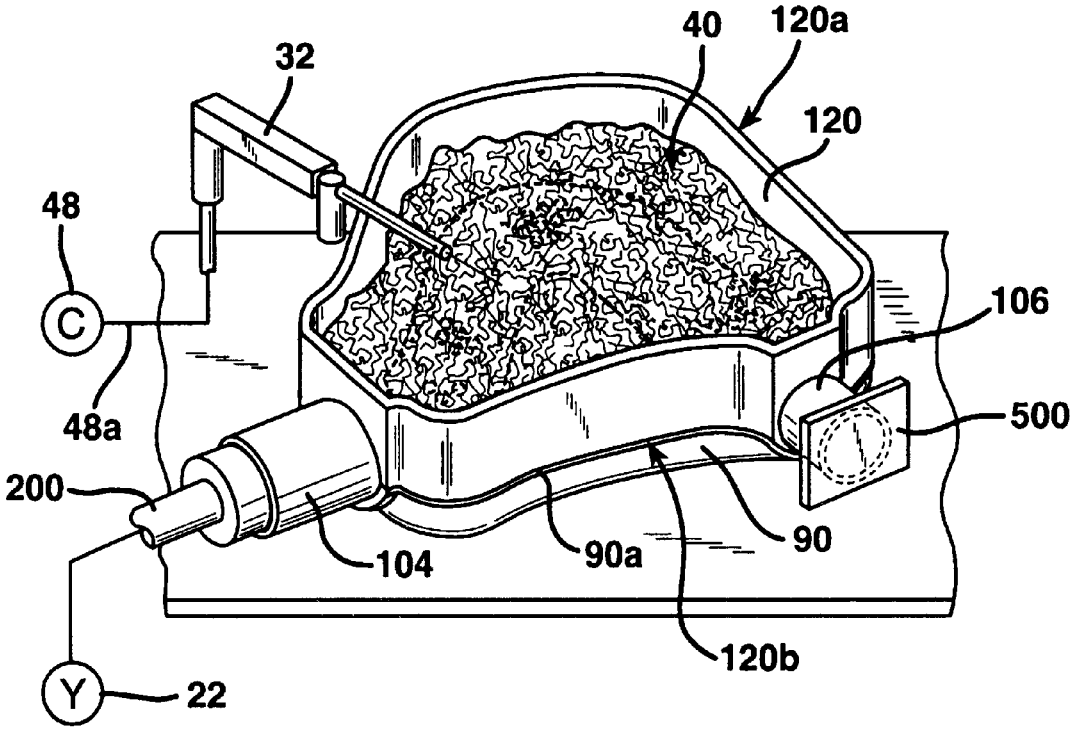
FIG. 13 illustrates the filling of a form placed over the first shell with fibrous material.

A form 120 having open upper and lower ends 120*a* and 120*b* is positioned over the first shell 90, see FIG. 13. The form 120 has an outer perimeter which has a shape similar to the outer perimeter of the shell 90. The form 120 may be formed from any one of the materials set out above from which the form 30 is formed. The form 120 is positioned on an outer edge 90*a* of the first shell 90 and may be secured to the first shell 90, if necessary, using, for example, adhesive tape.

The texturizing device 32 discussed above is used to fill the form 120 with fibrous material 40.

Prior to the fibrous material 40 filling operation, a conduit 200, extending from a conventional vacuum source 22, is coupled to end 104 of the perforated pipe structure 102, see FIG. 13. While the vacuum source 22 is activated, a plate 500 is positioned over open end 106 of the pipe structure 102 to prevent air from being drawn through this end. Hence, a partial vacuum is drawn through the perforations in the pipe structure 102 such that air is removed or drawn out of the form 120 via the perforated pipe structure 102. The form 120 is then filled with fibrous material 40, preferably while the vacuum source 22 is activated. The nozzle 31 is positioned just above or extended into the open end 120*a* of the form 120, see FIG. 13. Continuous strand material and pressurized air are supplied to the texturizing device 32 until a desired amount of fibrous material 40 is provided in the form 120. The pressurized air is supplied from a conventional compressor 48, which communicates with the device 32 via a hose 48*a*. The continuous strand material comprises one or more strands each of which may comprise a plurality of glass filaments selected from the group consisting of E-glass filaments and S-glass filaments. Preferably, the continuous strand material comprises a roving sold by Owens Corning under the trademark ADVANTEX® or the trademark Zen Tren™. The pressurized air separates and entangles the filaments of the strand material so that the strand material emerges from the nozzle 31 as a continuous length of "fluffed-up" or fibrous material 40. The form 120 may be filled partially or completely depending upon the amount of fibrous material 40 required to achieve a desired acoustic absorption rate for the muffler 80.

Figure 14:
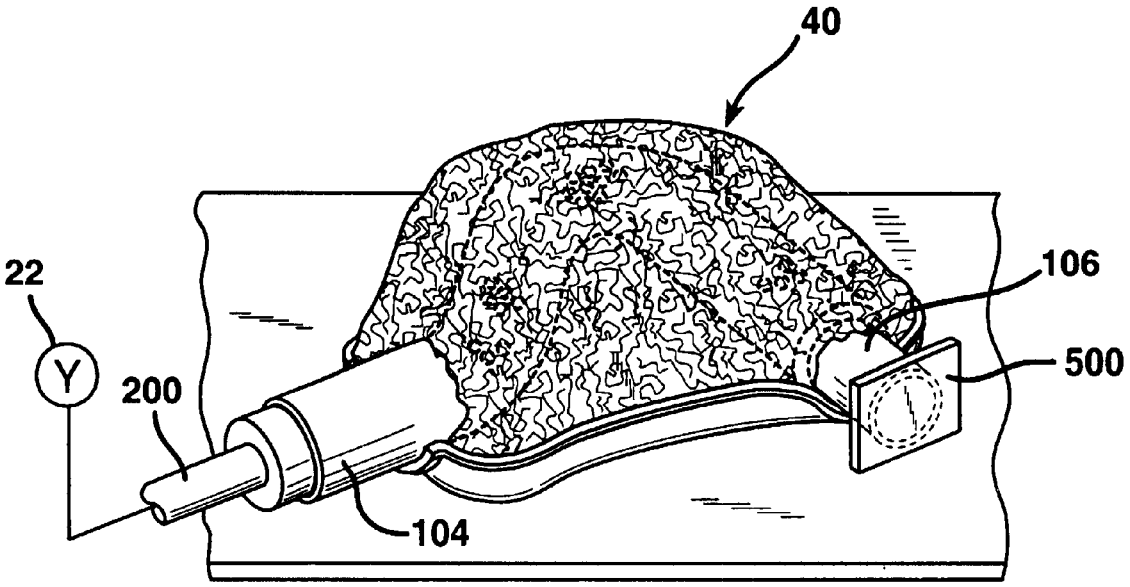
FIG. 14 illustrated the fibrous material, first shell and perforated pipe structure after the form is removed.

After the form 120 is filled with a desired amount of fibrous material 40, it is removed, see FIG. 14. Preferably, the vacuum source 22 remains activated after the form 120 is removed.

The second shell 92 is then placed over the first shell 90, see FIG. 15. As the distance between the shells 90 and 92 decreases as they come together, the velocity of the air being drawn between those two shells 90 and 92 via the vacuum device 22 increases. This increased air velocity causes any glass fibers of the fibrous material 40 extending outwardly from the outer edges of the two shells 90 and 92 to be drawn into an inner cavity defined by the shells 90 and 92. This is advantageous as any glass fibers extending out from the outer edges of the shells 90 and 92 may have a detrimental impact on the weld at that point, i.e., may cause a void in the weld, and exposed fibers are aesthetically undesirable.

The shells 90 and 92 are then coupled together via a conventional rolling, crimping, see FIG. 15, or welding process. Alternatively, the shells 90 and 92 may be coupled together using bolts, clips, bands or like fastening devices.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A process for filling a muffler shell with fibrous material comprising the steps of:

providing a muffler shell comprising first and second muffler shell outer parts which define an internal cavity when coupled together and an internal structure adapted to extend at least part way through the shell internal cavity for defining at least one channel having one or more openings communicating with the shell internal cavity;

placing a form over at least one of said internal structure and said first muffler shell part;

drawing a partial vacuum through a first end of said channel;

feeding fibrous material into said form while drawing a partial vacuum through said channel;

removing said form after said fibrous material feeding step; and positioning said second muffler shell part over at least one of said internal structure and said first muffler shell part.

2. A process as set forth in claim 1, wherein said partial vacuum is also drawn through said channel after said form is removed and during said positioning step.

3. A process as set forth in claim 1, wherein said form comprises a structure having upper and lower open sections and an outer perimeter shaped like that of each of said first and second shell parts.

4. A process as set forth in claim 1, wherein said feeding step comprises the steps of:

providing a nozzle;

feeding continuous strand material and pressurized air into said nozzle such that a wool-type product emerges from said nozzle; and positioning said nozzle adjacent to or in said form such that said wool-type product is fed into said form.

5. A process as set forth in claim 1, wherein said internal structure comprises a perforated pipe.

6. A process as set forth in claim 1, wherein said internal structure comprises a pair of stamped plates in face-to-face relationship which define said at least one channel.

7. A process as set forth in claim 6, wherein said stamped plates are coupled together before said feeding step.

8. A process as set forth in claim 6, wherein said stamped plates are coupled together after said feeding step.

9. A process as set forth in claim 6, wherein said positioning step comprises the step of positioning said second muffler shell part over said plates and further comprising the steps of placing said plates over a deformable panel prior to said feeding step and removing said plates from said deformable panel after said second shell part has been positioned over said plates.

10. A process as set forth in claim 9, wherein said placing step comprising placing said form over a first side of said pair of stamped plates and further comprising the steps of:

placing said form over a second side of said pair of stamped plates;

drawing a partial vacuum through said first end of said channel;

feeding fibrous material into said form while drawing a partial vacuum through said channel and with said form over said second side of said plates;

removing said form after said fibrous material feeding step; and positioning said first muffler shell part over said plates and said second muffler shell part.

11. A process as set forth in claim 10, further comprising the step of coupling said first and second muffler shell parts together.

12. A muffler filled with fibrous material in accordance with the process set out in claim 1.

13. A process for filling a muffler shell with fibrous material comprising the steps of:

providing a muffler shell comprising first and second muffler shell parts which define an internal cavity when coupled together and an internal structure adapted to extend at least part way through the shell internal cavity for defining at least one channel having one or more openings communicating with the shell internal cavity;

placing a form over at least one of said internal structure and said first shell part;

drawing a partial vacuum through a first end of said channel;

feeding fibrous material into said form;

removing said form after said fibrous material feeding step; and positioning said second muffler shell part over at least one of said internal structure and said first shell part.

14. A process as set forth in claim 13, wherein said partial vacuum is also drawn through said channel during said fibrous material feeding step, after said form is removed and during said positioning step.

15. A process as set forth in claim 13, wherein said feeding step comprises the steps of:

providing a nozzle;

feeding continuous strand material and pressurized air into said nozzle such that a wool-type product emerges from said nozzle; and positioning said nozzle adjacent to or in said form such that said wool-type product is fed into said form.

16. A process as set forth in claim 13, wherein said internal structure comprises a perforated pipe.

17. A process as set forth in claim 13, wherein said internal structure comprises a pair of stamped plates in face-to-face relationship so as to define said at least one channel.

18. A process as set forth in claim 17, wherein said positioning step comprises the step of positioning said second muffler shell part over said plates and further comprising the steps of placing said plates over a deformable panel prior to said feeding step and removing said plates from said deformable panel after said second shell part has been positioned over said plates.

19. A process as set forth in claim 18, wherein said placing step comprising placing said form over a first side of said pair of stamped plates and further comprising the steps of:

placing said form over a second side of said pair of stamped plates;

drawing a partial vacuum through said first end of said channel;

feeding fibrous material into said form while drawing a partial vacuum through said channel and with said form over said second side of said plates;

removing said form after said fibrous material feeding step; and positioning said first muffler shell part over said plates and said second muffler shell part.

* * * * *